United States Patent [19]

Torick

[11] Patent Number: 4,752,955

[45] Date of Patent: Jun. 21, 1988

[54] FM STEREOPHONIC SYSTEM HAVING IMPROVED COMPATIBILITY IN PRESENCE OF MULTIPATH

[75] Inventor: Emil L. Torick, Norwalk, Conn.

[73] Assignee: Broadcast Technology Partners, Bloomfield Hills, Mich.

[21] Appl. No.: 30,223

[22] Filed: Mar. 25, 1987

[51] Int. Cl.[4] ..... H04H 5/00

[52] U.S. Cl. ..... 381/13

[58] Field of Search ..... 455/72, 103; 332/23 A; 370/6, 20; 381/2, 3, 4, 13

[56] References Cited

U.S. PATENT DOCUMENTS

| | | | |
|---|---|---|---|
| 3,594,506 | 7/1971 | Bauer et al. | 73/646 |
| 4,388,493 | 6/1983 | Maisel | 381/4 |
| 4,485,483 | 11/1984 | Torick et al. | 381/14 |
| 4,534,054 | 8/1985 | Maisel | 381/4 |
| 4,602,380 | 7/1986 | Stebbings | 381/13 |
| 4,602,381 | 7/1986 | Cugnini et al. | 381/13 |
| 4,704,727 | 11/1987 | Beard | 381/13 |

OTHER PUBLICATIONS

T. Bossert, "Impairments to VHF/FM Reception in Motor Vehicles Caused by Multipath Propagation and Possibilties for Improving Receivers", EBU Review--Technical, No. 205, Jun. 1944, pp. 111-116.

*Primary Examiner*—Forester W. Isen

*Attorney, Agent, or Firm*—Spencer E. Olson

[57] ABSTRACT

The compatibility of an FM stereophonic broadcasting system incorporating companding of the difference signal, in which both the usual difference signal and a compressed version of the difference signal are transmitted, with conventional FM receivers is improved by minimizing crosstalk from the compressed difference signal to the usual difference signal that sometimes occurs in conventional FM stereo receivers, particularly when the multiplex signal is received under multipath propagation conditions. Crosstalk in conventional receivers is significantly reduced, without an attendant lessening of perceived noise reduction in the companded system, by inverting the phase of the audio signals contained in the compressed difference signal relative to the audio content of the usual difference signal, and also adjusting the relative amplitudes of different portions of the audio frequency spectrum of the compressed difference signal in approximate correspondence with the response of the human hearing mechanism to sound loudness level. In the receiver of the companded system the relative amplitudes of the audio signals contained in the spectrum of the received compressed difference signal are restored to have the levels they had before adjustment at the transmitter, and their phase inverted to put them in phase with corresponding audio signals in the received uncompressed difference signal, and then expanded complementarily with the compression characteristic utilized at the transmitter.

10 Claims, 3 Drawing Sheets

L
R
6
75 μ sec. PRE-EMPH
8
75 μ sec. PRE-EMPH
10
MATRIX
M= (L+R)
12
DELAY
14
ADDER
32
FM EXCITER AND TRANSMITTER
16
DELAY
S= (L-R)
18
MODULATOR "S"
20
COMP-RESSOR
22
INVERT.
24
EQUAL-IZER
26
MODULATOR "S"
cos wt.
30
90° PHASE SHIFT
sin wt
28
CARRIER GENERATOR
sin wt/2

FM STEREOPHONIC SYSTEM HAVING IMPROVED COMPATIBILITY IN PRESENCE OF MULTIPATH

BACKGROUND OF THE INVENTION

This invention relates to FM broadcasting systems and, more particularly, to an improved FM stereophonic broadcasting system which increases the broadcast coverage area over that of current biphonic service yet is compatible with existing monophonic and biphonic receivers in the presence of multipath propagation.

U.S. Pat. No. 4,485,483, the disclosure of which is hereby incorporated herein by reference, describes a stereophonic broadcasting system incorporating companding of the difference signal which is compatible with existing receivers and which through signal-to-noise improvement significantly extends the area of coverage of an FM broadcasting station. In the patented system, and as illustrated in FIG. 1, stereophonically-related audio frequency source signals L and R are matrixed to obtain stereophonic sum and difference signals M and S, respectively. At the transmitter, the difference signal is used to amplitude-modulate a first sub-carrier signal and at the same time is applied to a compressor which compresses its dynamic range to produce a compressed difference signal S'. The compressed signal S' is used to amplitude-modulate a second subcarrier signal of the same frequency but in quadrature phase relationship with the first. Suppressed-carrier, double-side-band modulation is employed, with the frequency of the sub-carrier signal being sufficiently high to assure a frequency gap between the lower sidebands of the modulated sub-carrier signals and the M signal. A conventional low-level phase reference pilot signal, lying within the aforementioned frequency gap is provided for detection purposes at the receiver. The M signal, the two modulated sub-carrier signals, and the pilot signal are frequency modulated onto a high frequency carrier for the purpose of transmitting the same to one or more remote receivers. The receiver includes a demodulator for deriving the M signal, the normal difference signal S and the compressed difference signal S', and an expander for complementarily expanding the derived compressed difference signal. The expanded noise-reduced version of the difference signal is combined with the received sum signal M to obtain the original audio frequency source signals L and R. In addition to improving the quality of the received signal, the system increases the broadcast coverage area over that of current biphonic service.

Commonly assigned U.S. Pat. No. 4,602,380, the disclosure of which is hereby incorporated herein by reference, describes compressors and expanders useful in the above-described system and teaches the concept of combining, at the receiver, the usual stereo difference signal S and the compressed stereo difference signal S' and then expanding the resulting signal to obtain a noise-reduced difference signal for matrixing with the sum signal. Commonly assigned U.S. Pat. No. 4,602,380, the disclosure of which is also hereby incorporated herein by reference, describes the use of the difference signal S as a reference signal for controlling the expansion of the received compressed difference signal S' so as to cause the amplitude of the expanded difference signal to equal the level of the uncompressed difference signal, making the expander adaptive to any compression characteristic that might be employed at the transmitter.

The system described in these three patents is compatible with conventional receivers provided they are properly aligned so as not to detect the added compressed difference signal; however, a problem can arise when the alignment of the receiver fails to maintain the proper phase relationship between the pilot signal and the sub-carriers. Under such circumstances, there may be crosstalk of the compressed signal into the uncompressed difference signal and, depending on the direction of the phase misalignment, may add to or subtract from the usual difference signal. The magnitude of the crosstalk will be affected both by the amount of compression (gain) of the compressed signal and the magnitude of the alignment phase error. If the phase error is negative, the crosstalk will be out-of-phase and may contribute to a potential narrowing of the apparent stereo stage width. If the phase error is positive, the crosstalk will be in-phase and may contribute to an apparent widening of the stereo image. In actual practice, neither effect is likely to be noticed because the alignment of most receivers falls within a tolerable range.

The problem is more severe, however, with reception in moving vehicles because of the multipath propagation phenomenon, a condition in which a receiving antenna is sensitive to both a direct transmitted signal as well as to multiple, delayed reflections of that signal caused by terrain factors or manmade structures. Depending on delay intervals, multipath propagation can decrease the level of the received RF signal so as to cause noisy reception or complete signal dropouts. In conventional stereo receivers, the effect is characterized by momentary bursts of noise as the vehicle moves through the multipath space. In addition to this RF signal fading, the summation of the multipath signals at the receiver may also distort the phase relationship between the pilot signal and the stereo difference signal. If the transmitted signal also includes the added compressed difference signal S', such momentary phase errors can result in momentary bursts of crosstalk as well as noise. Since the level of the compressed difference signal is generally higher than that of the uncompressed signal, if the phase error is such as to cause crosstalk summation of the two stereo difference signals, loud bursts of sound may be heard. The effect can be lessened if the overall compression (gain) of the difference signal in the quadrature channel is reduced, but to do so would also reduce the effectiveness of the noise-reduction function.

It has been observed that, in general, the most common and deleterious multipath is characterized by relatively short delay times and a low ratio of desired-to-undesired (D/U) signals. Such reception is usually encountered in urban environs where steel frame buildings nearby act as efficient reflectors of the RF signals. It has also been observed that the crosstalk is audibly more objectionable when the audio signals in the compressed and uncompressed channels are in phase with each other, and that the effect is lessened when these signals are 180° out-of-phase with respect to each other. This observation may be explained in terms of the above-mentioned phase error of the pilot tone.

Employing the analysis technique described in an article by T. Bossert entitled, "Impairments to VHF/FM reception in motor vehicles caused by multipath propagation and possibilities for improving receivers", *EBU Review-Technical,* No. 205, June 1984, and referring to FIG. 2, the curve illustrates the effect on a 19 kHz pilot tone of a second attenuated and delayed 19 kHz signal. The desired or direct signal is represented by vector D, and the undesired signal, represented by vector U, is delayed by the angle $\alpha$. The vectorial sum of these two signals is represented by the dashed line vector labeled $\Sigma$. For purposes of this illustration, the undesired signal U is shown to be at a level 3dB lower than that of the direct signal and delayed in time approximately equivalent to the propagation time of an added mile of signal path. It can be seen that the resultant phase error $\phi$ will always be positive until the delay times exceed one-half the period of the pilot tone, or approximately 26 microseconds, which is equivalent to a D-U path difference of nearly five miles. It is also to be expected that as delay times approach this larger value, the amplitude of the undesired signal will decrease due to the attenuation factor of the longer propagation path. Consequently, the error angle $\phi$ is not likely to change sign for most multipath signals. Given this analysis, it is therefore desirable to configure the audio phase in the compressed difference channel so as to minimize degradation in compatible reception.

As stated earlier, the degradation of the crosstalk effect on the conventional difference signal can be minimized by reducing the gain of the compressed signal, but if the gain at all frequencies were reduced by a like amount the effectiveness of the noise reduction would be lessened. Applicant has recognized, however, based on his earlier analysis of the frequency sensitivity of the human hearing response, that it is possible to reduce the level of low frequency information in the compressed difference signal without affecting the perceived noise reduction. This is possible because of the frequency sensitivity of the human hearing mechanism, exemplified by the equal loudness contours derived by applicant and others illustrated in U.S. Pat. No. 3,594,506 entitled "Loudness Level Indicator," the disclosure of which is hereby incorporated by reference. Equal loudness contours graphically depict the measurement of levels of sound of equal loudness as a function of frequency and intensity and may be obtained by subjecting test teams to octave bands of pink noise, pink noise being characterized as having equal energy distribution per octave band. Such equal loudness contours indicate that the human ear is less sensitive to a given loudness level at sound frequencies below about 1,000 Hz than it is to sound frequencies about 1,000 Hz; applicant has recognized that this effect can be utilized to reduce crosstalk from the compressed difference signal S' to the difference signal S, in conventional FM stereo receivers, without lessening the perceived noise-reduction at the receiver of the extended range system.

A primary object of the present invention is to provide an improved FM stereophonic broadcasting system incorporating companding of the difference signal which exhibits improved compatibility with conventional FM stereo receivers in the presence of multipath propagation.

SUMMARY OF THE INVENTION

In an FM stereo broadcasting system in which the usual stereo difference signal S and a compressed stereo difference signal S' are both transmitted, the audio signals contained in the signals S and S' are reversed in phase relative to each other for minimizing crosstalk, in conventional FM stereo receivers, from signal S' to signal S, so as to improve its compatibility with conventional receivers. Further improvement is provided by adjusting the relative amplitudes of different portions of the audio frequency spectrum of the compressed difference signal S' in approximate correspondence with the response of the human hearing mechanism to sound loudness level, the effect of which is to minimize crosstalk in conventional FM stereo receivers without lessening the noise-reducing capability of the corresponding system as perceived by the listener. For example, signals in the portion of the spectrum below about 1,000 Hz are attentuated relative to signals having higher frequencies.

In the receiver, the level of the audio signals in the lower portion of the spectrum of the received compressed difference signal S' is restored to the level of the balance of the spectrum, and the phase of the audio signals contained in the full compressed signal S' spectrum reversed to put them in phase with corresponding audio signals in the received stereo difference signal S' before being expanded.

BRIEF DESCRIPTION OF THE DRAWINGS

Other objects, features and advantages of the invention, and a better understanding of its construction and operation, will be had from the following detailed description when considered in conjunction with the accompanying drawings, in which.

DETAILED DESCRIPTION

Figure 1:
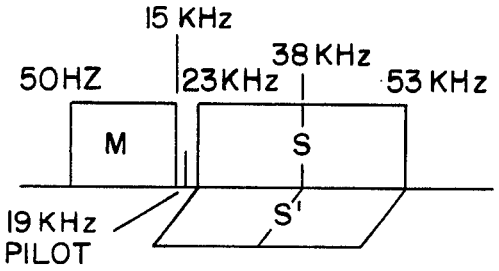
FIG. 1, to which reference has already been made, is a frequency diagram of the composite baseband signal developed in accordance with the principles of the invention.
Figure 2:
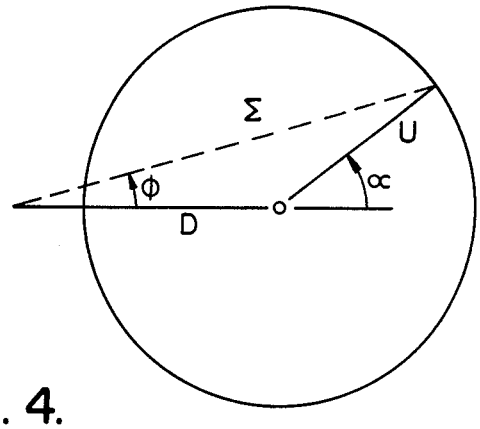
FIG. 2, to which previous reference has been made, illustrates the vectorial addition of desired and undesired received signals caused by multipath propagation.

In order that the FM stereophonic broadcasting system according to the invention be compatible with the existing two-channel stereo system approved by the FCC, the stereo generator at the transmitter adds stereophonically related signals L and R to form a sum signal M having frequencies up to about 15,000 Hz, to which is added a double-sideband suppressed 38 kHz sub-carrier signal S, and a 19 kHz pilot signal for receiver synchronization purposes. Thus, the signal has the baseband spectrum illustrated in FIG. 1 comprising a monophonic channel M from about 50 Hz to 15 kHz, a 19 kHz pilot, and a conventional stereophonic difference channel S from 23 to 53 kHz. In common with the system described in U.S. Pat. No. 4,485,483, a compressed difference signal S' amplitude-modulated on a 38 kHz quadrature sub-carrier, is added to the conventional composite FM signal.

Figure 3:
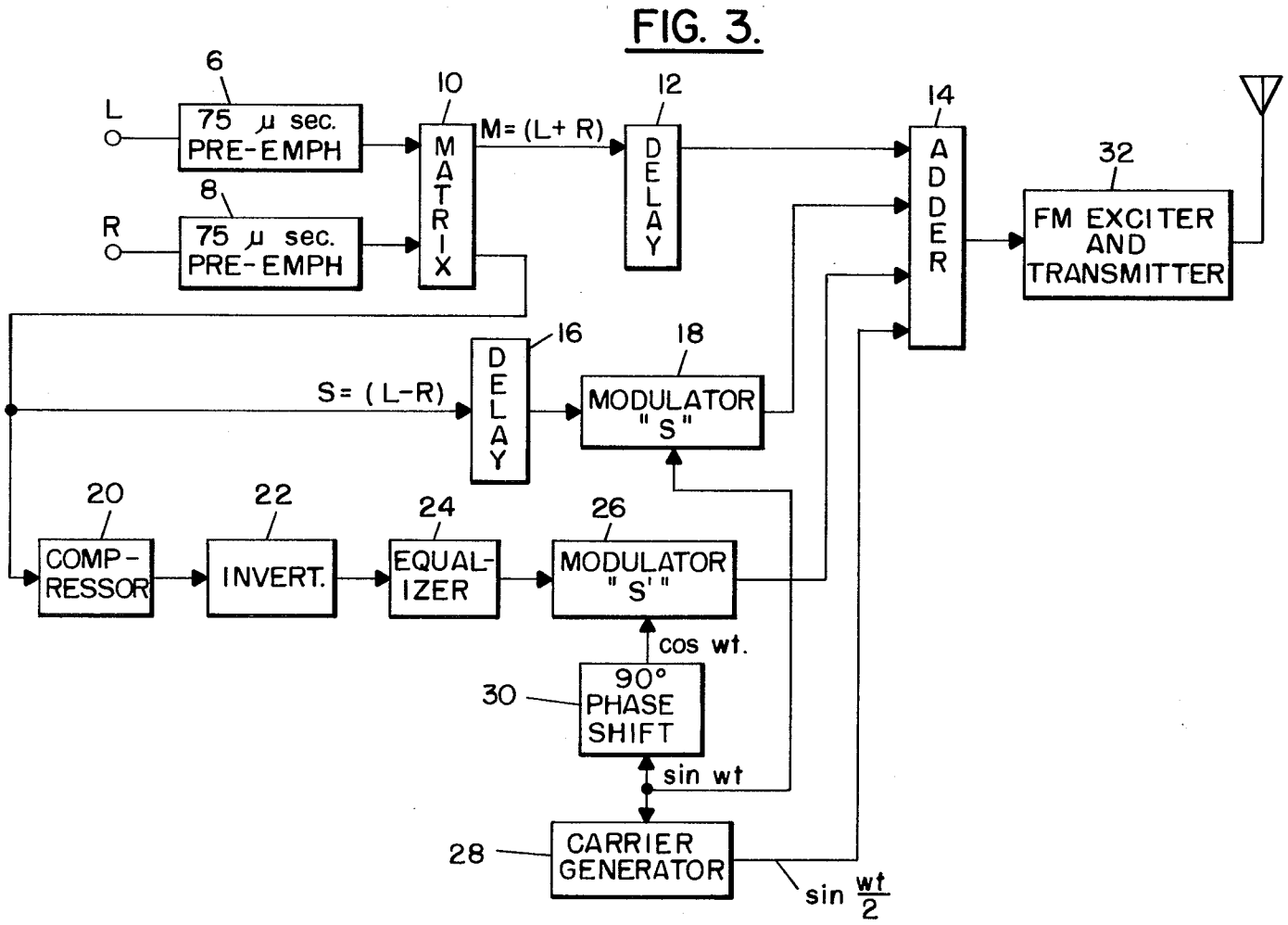
FIG. 3 is a simplified block diagram of a transmitting terminal for generating and transmitting the composite signal of FIG. 1.

A transmitter for generating this composite signal, modified to achieve minimization of deleterious crosstalk caused by multipath propagation, is illustrated in FIG. 3 which, in the interest of simplicity, omits some of the more conventional transmitter circuits. The two audio frequency signals L and R, derived from separate sources (not shown) are applied via conventional 75 microsecond pre-emphasis networks 6 and 8, respectively, to the inputs of a conventional matrix network 10 consisting, for example, of a network of summing amplifiers arranged to produce at the output terminals of the matrix the two audio signals $M=(L+R)$ and $S=(L-R)$. The monophonic sum signal M is applied via a first delay device 12 to one input of an adder 14, and the stereophonic difference signal S is applied via a second delay device 16 to the input of a first modulator 18, the output of which is applied to a second input of adder 14. As shown in the upper portion of FIG. 4, in which both frequency and signal amplitude are presented on logarithmic scales, the conventional difference channel encompasses an audio frequency spectrum from about 20 Hz to about 15,000 Hz and exhibits a substantially flat amplitude-frequency characteristic. The reason for the upper frequency limitation at approximately 15 kHz is, of course, to prevent audio signals from interfering with the 19 kHz pilot tone. For purposes of comparing the uncompressed difference channel with the compressed difference channel shown in the lower portion of FIG. 4, the uncompressed difference sub-channel is shown as having an amplitude of 0 dB.

Figure 4:
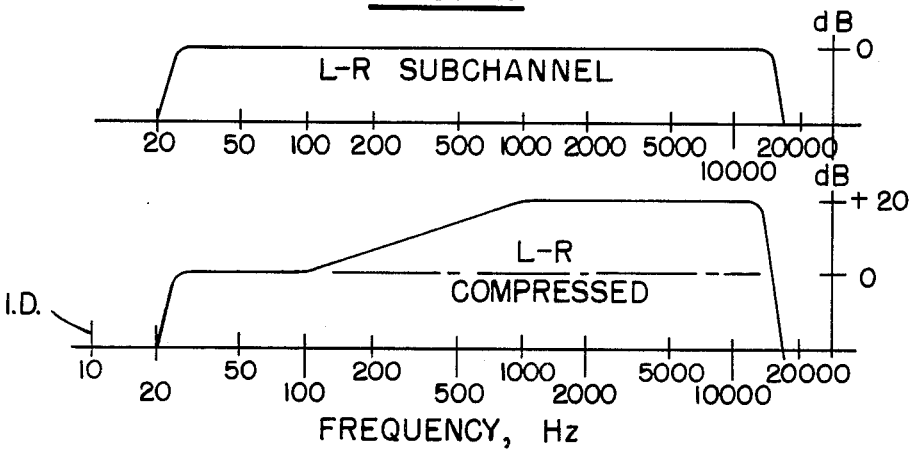
FIG. 4 illustrates the amplitude versus frequency spectrum of each of the uncompressed and compressed difference channels of the FM multiplex signal shown in FIG. 1.

According to the present invention, for purposes of minimizing crosstalk from the quadrature compressed difference signal to the usual difference signal, the phase of the program material in the compressed channel is reversed in phase relative to the uncompressed channel, and also, as best seen from the curve in the lower portion of FIG. 4, the lower frequencies are attenuated. The compressed signal, characterized as S', has the same upper and lower frequency limits as the usual difference sub-channel and, unless modified according to the principles of the present invention would have a relative amplitude of 20dB; that is to say, the compressor (to be described) typically introduces a gain of about 20dB over the level of the standard stereo difference signal. As shown, the compressed difference signal has an amplitude of 20dB over the range from about 1,000 Hz to about 15,000 Hz, and rolls off from about 1,000 Hz to about 100 Hz at a rate of about 6dB per octave to a level of 0db, that is, to the level of the uncompressed difference signal, and remains at that level until the lower limit of the passband is reached. Summarizing, the compressed difference signal used to amplitude-modulate the quadrature modulator has the same amplitude as the uncompressed difference signal from the lower end of the illustrated pass band up to a frequency of about 100 Hz, then increases to a level of about 20dB at a frequency of about 1,000 Hz at which it is maintained for the balance of the spectrum.

Accompanying the compressed difference signal is a frequency component at 10 Hz which is transmitted in the quadrature channel for indicating to a receiver so equipped that the received signal contains a compressed version of the difference signal. Because of its small amplitude, this 10 Hz component is not drawn to the scale of the rest of the waveform; whereas the amplitude of the stereophonic difference signals produce 40% to 50% of the total deviation of the radio frequency sub-carrier, the identification signal is injected at a level that causes only a 1% deviation of the RF carrier. Not only is it appropriate that the identification signal accompany the quadrature sub-channel that it represents, but also by virtue of its being in the quadrature channel it is hidden to existing stereo and monophonic receivers.

Although the curve of FIG. 4 shows a roll off of 20dB over a frequency range from 1,000 Hz to 100 Hz, these frequencies are not critical, nor is the nature of the roll off. The purpose of the roll off is to reduce the audible effect of multipath distortion in conventional receivers, it being recognized however, that in doing so there will be less noise reduction when the signal is complementarily expanded. In other words, the most noise reduction occurs in that part of the spectrum above about 1 kHz, and at frequencies below about 100 Hz there will be little or no noise reduction, at least not on a measured voltage basis. However, because the response of the human hearing system is most sensitive to the higher audio frequencies, the slope of the FIG. 4 waveform desirably is closely equivalent to the slope which corresponds to the equal loudness contours of the hearing response.

Returning now to the description of FIG. 3, to obtain a compressed difference signal S' having the response characteristic illustrated in FIG. 4, the difference signal S from matrix 10 is applied to a compressor 20 which may be of the type described in the aforementioned U.S. Pat. No. 4,602,380, which includes a variable gain device for controlling the gain of the input signal and a circuit for generating a control signal for the variable gain device including a rectifier for producing responsively to the input signal a DC signal which substantially follow dynamic variations of the input signal. The compressed difference signal S' is applied to an equalizer 22 which may be a conventional filter including a high pass section designed to roll off at about 1,000 Hz and a stop filter for terminating the roll off at the 0dB level for frequencies below about 100 Hz.

The output of equalizer 22 is applied to an inverter 24 which shifts the phase of the audio by 180° relative to the difference signal S. Although the filter and inverter are shown as separate functional blocks, in actual practice the filter may be an inverting filter which accomplishes in one component the necessary amplitude modification and phase reversal. The compressed difference signal modified by equalizer 20 to have the amplitude versus frequency characteristic illustrated in FIG. 4, is applied to the input of a second modulator 26, the output of which is also applied to adder 14 where it is linearly combined with the monophonic signal M and the signal from modulator 18.

The sub-carrier and pilot signals are derived from a carrier generator 28 which provides a sine wave signal having a frequency of 38 kHz which is applied to modulator 18 and also to a phase shift network 30 of known construction for providing a 90° phase displacement between the sub-carrier signal applied to modulator 26 and the sub-carrier applied to modulator 18. The modulators 18 and 26 comprise suppressed-carrier amplitude modulators of known construction which serve to amplitude-modulate the two sub-carriers with respective audio frequency signals so as to produce two double-sideband, suppressed-carrier, amplitude-modulated sub-carrier signals. These two signals are combined in adder 14 with the sum signal M and a 19 kHz sine wave pilot signal, also derived from carrier generator 28. The composite signal produced at the output of adder 14 is then applied to the FM exciter of a transmitter 32 and frequency modulated onto a high frequency carrier for transmission.

Figure 5:
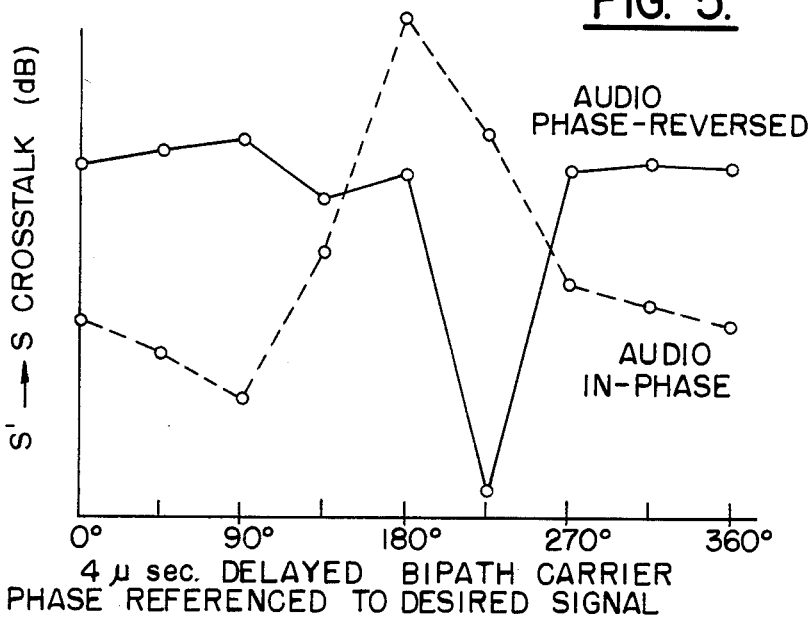
FIG. 5 is a set of curves which illustrate the effect of the relative phase of the audio signals contained in the compressed channel.

FIG. 5 depicts the measured results of inverting the phase of the compressed audio difference signals relative to the uncompressed audio difference signals. The dashed line curve represents the crosstalk in dB from the compressed difference signal S' to an in-phase uncompressed signal S for the case of 20dB compression of a 1 kHz audio signal. The crosstalk effect is most pronounced when the delayed RF signal is 180° out-of-phase with the desired signal. When the audio frequency signals are out-of-phase, there is attenuation of the peak level of the crosstalk as shown by the solid line curve.

Figure 6:
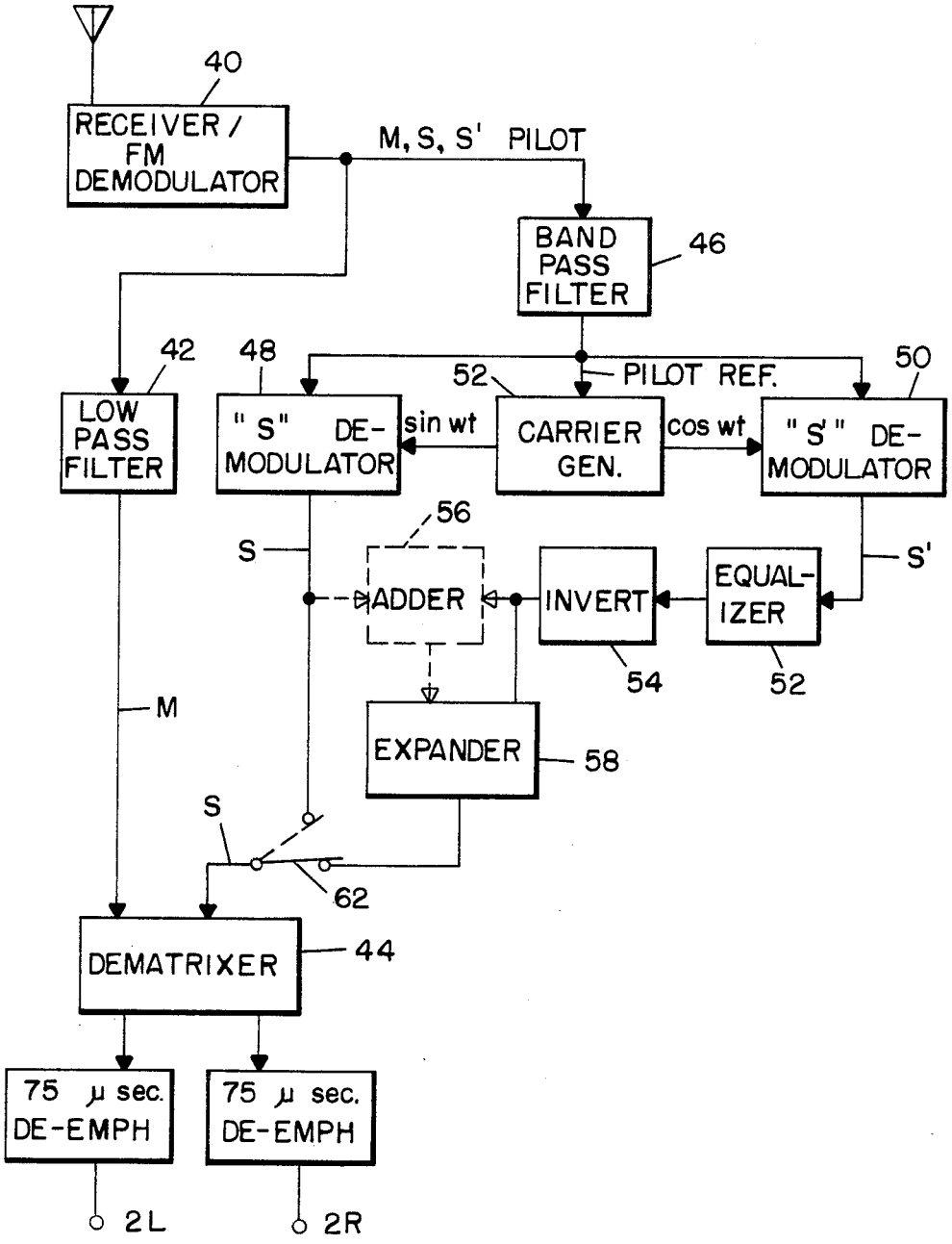
FIG. 6 is a simplified block diagram of a receiving terminal constructed in accordance with the invention.

A receiver according to the invention is shown in the block diagram of FIG. 6 and, again, in the interest of simplicity, some of the more conventional FM receiver circuits (e.g., RF and IF stages and discriminator networks) have not been shown and will be only briefly mentioned as necessary. A received FM signal is amplified in the RF and IF stages (not shown) of a receiver/FM demodulator 40, and demodulated in any of the known FM detection circuits (not shown) to derive the audio signals contained in the received signal, namely, the signals M, S, S' and the pilot. The monophonic sum signal M is separated from the higher frequency components of the composite signal by a low-pass filter 42 and applied as one input to a dematrixer circuit 44 of conventional design. The remaining components of the composite signal are selected by a bandpass filter 46 designed to pass frequencies in the band from 19 kHz to 53 kHz and to reject frequencies below this band and applied to an S demodulator 48 and to an S' demodulator 50. The pilot signal is derived by conventional means (not shown) and applied to a carrier generator 52 which regenerates quadrature versions thereof, which are applied to demodulators 48 and 50, respectively.

For the proper expansion of the compressed difference signals, the audio freqency output signal from demodulator 50 is modified so as to have a flat response throughout its spectrum and, of course, its phase must be reversed to put it in phase with the uncompressed difference signal delivered by demodulator 48. To this end, the output of demodulator 50 is applied to a equalizer 52 designed to have a frequency response which is substantially the inverse of the characteristic shown in the lower portion of FIG. 4. This equalizer may take the form of a filter of conventional design. After equalization and phase inversion by an inverter 54 which, as in the transmitter, can be accomplished in a single inverting filter, the signal S' is applied to an expander 58 which expands the signal complementarily with the compression characteristic to obtain the noise-reduced signal S at its output for delivery to a second input to dematrixer 44 when a switch 62 is in the position shown. The dematrixer 44, which may be of conventional construction, combines the M and noise-reduced S signals to produce as outputs the signals 2L and 2R, the amplitude of which is then reduced by one-half to obtain signals L and R for application to the left and right loudspeakers, respectively (not shown), all typical of the mode of operation of a conventional two-channel FM receiver.

Alternatively, and in accordance with the teachings of aforementioned U.S. Pat. No. 4,602,380, the output signal S' from inverter 54 may be summed with the uncompressed difference signal S in an adder 56, and the sum signal applied to the expander 58.

The described receiver is compatible with conventional monophonic and two-channel (biphonic) stereophonic broadcasts. When a monaural broadcast is being received, the output of receiver/FM demodulator 40 comprises only the monaural signal M consisting of (L +R). This signal is selected by lowpass filter 42 and applied to dematrixer 44, and since no signal is applied to the second input, only the signal M appears at each output of the dematrixer for application to the left and right loudspeakers.

The receiver is enabled to reproduce a received conventional two-channel stereo signal by actuating the switch 62, preferably automatically, from the position shown to the dotted-line position so as to connect the output of the demodulator 48 to the second input of the dematrixer. Such automatic switching can be achieved by a detector (not shown) which is responsive to the identification signal described earlier and transmitted in the compressed difference signal subchannel to produce a signal for actuating switch 62 to the dotted-line position. Thus, when a conventional two-channel stereo signal is received, the M signal, as before, is applied to one input of dematrixer 74, and the S signal, derived from demodulator 48, and applied to the other input, are combined to produce output signals 2L and 2R, the amplitude of each of which is reduced by one-half prior to application to the left and right loudspeakers, respectively.

The described embodiments of the transmitter and receiver are susceptible of modification in form and detail within the scope of the invention. For example, the frequency break points of the response characteristic of the compressed difference signal depicted in FIG. 4 may be different from those specifically described by way of example; e.g., the two frequency points might be an octave lower, or one or the other might be individually changed if an equalizer with a different slope of attenuation is used. Also, the nature and the implementation of the compressor, the expander, and the inverting filters are susceptible of some latitude. The specific illustrative embodiment is exemplary only, and such variations and modifications as will now be suggested to those skilled in the art will be understood as forming part of the present invention insofar as they fall with the spirit and scope of the appended claims.

I claim:

1. In a compatible stereo transmission system including means for generating, transmitting and receiving an FM multiplex signal derived from left and right audio stereo signals, said multiplex signal including a sum signal, a stereo difference signal S amplitude-modulated on a first sub-carrier, a compressed version S' of said stereo difference signal amplitude-modulated on a quadrature sub-carrier, and a pilot signal, means for improving the compatibility of said system with conventional FM receivers, comprising:

means in addition to said means for generating said compressed version S' for minimizing crosstalk from said compressed stereo difference signal S' to said stereo difference signal S in a conventional FM receiver, without lessening the perceived noise reduction at said receiving means of the system.

2. Apparatus according to claim 1, wherein said means for minimizing crosstalk comprises:

means for changing the phase of the audio signals contained in said compressed stereo signal S' by 180° relative to corresponding audio signals contained in said stereo difference signal S.

3. Apparatus according to claim 1, wherein said means for minimizing crosstalk comprises:

equalizing means for adjusting the relative amplitude of different portions of the audio frequency spectrum of said compressed stereo difference signal S' to correspond approximately to the loudness response of the human ear.

4. Apparatus according to claim 3, wherein said means for minimizing crosstalk further comprises:

means for changing the phase of audio signals contained in said compressed stereo difference signal S' by 180° relative to corresponding audio signals contained in said stereo difference signal S.

5. Apparatus according to claim 3, wherein said stereo difference signals S and S' each have an audio spectrum from about 20 Hz to about 15,000 Hz, wherein said equalizing means is operative to adjust the amplitude of audio signals in the portion of the spectrum of said compressed difference signal S' below about 1,000 Hz to a first level which is lower than the adjusted level of audio signals having frequencies above about 1,000 Hz, and wherein said stereo difference signal S has substantially said first level throughout its spectrum.

6. Apparatus according to claim 5, wherein said means for minimizing crosstalk further comprises:

means for changing the phase of audio signals contained in said compressed difference signal S' by 180° relative to corresponding audio signals contained in said stereo difference signal S.

7. Apparatus according to claim 1, wherein said first and quadrature sub-carriers each have a frequency of 38 kHz, and wherein said pilot signal has a frequency of 19 kHz.

8. A receiver for use in a compatible stereo transmission system for receiving an FM multiplex signal derived from left and right audio stereo signals and including a sum signal, a stereo difference signal S amplitude-modulated on a first sub-carrier, a compressed version S' of said stereo difference signal, which has been modified so that different portions of the audio frequency spectrum have been equalized to have relative amplitudes corresponding approximately to the loudness response of the human ear, and its contained audio signals are displaced 180° in phase relative to audio signals contained in said stereo difference signal S, said modified compressed version S' of said stereo difference signal amplitude-modulated on a quadrature sub-carrier, and a pilot signal, said receiver comprising:

means for deriving said sum signal, said stereo difference signal S and said modified compressed version S' of said stereo difference signal, means for performing equalization and phase displacement on said derived modified compressed version S' of said stereo difference signal to form a derived compressed version S' of said stereo difference signal, means for expanding said derived compressed version S' of said stereo difference signal, and means for combining said expanded version of the stereo difference signal with said derived sum signal for obtaining said left and right audio stereo signals.

9. A receiver according to claim 8, wherein said means for performing further comprises:

equalizing means for adjusting the relative amplitudes of different portions of the audio frequency spectrum of said derived modified compressed version S' of said stereo difference signal complementarily to the amplitude versus frequency response of said modified compressed version S' of said stereo difference signal.

10. A compatible stereo transmission system including means for generating, transmitting and receiving an FM multiplex signal derived from left and right audio stereo signals, said multiplex signal including a sum signal, a stereo difference signal S amplitude-modulated on a first sub-carrier, a compressed version S' of said stereo difference signal amplitude-modulated on a quadrature sub-carrier, and a pilot signal, said system comprising:

at the generating and transmitting means means in addition to said means for generating said compressed version S' for modifying said compressed difference signal S' for minimizing crosstalk from said compressed stereo difference signal S' to said stereo difference signal S in a conventional FM receiver, without lessening the perceived noise reduction at said receiving means of the system; and at the receiving means means for deriving from a received FM multiplex signal said sum signal, said difference signal S and said modified compressed difference signal S', means for altering said derived compressed difference signal S' substantially complementarily with the modification of the compressed difference signal at said generating and transmitting means, means for expanding said altered derived compressed difference signal S' to obtain an expanded noise-reduced version of said difference signal S, and means for combining said expanded noise-re-reduced version of the difference signal with the derived sum signal for obtaining said left and right audio stereo signals.

* * * * *